US006926075B2

(12) United States Patent
Matsushima

(10) Patent No.: US 6,926,075 B2
(45) Date of Patent: Aug. 9, 2005

(54) PLATE TYPE HEAT EXCHANGER

(75) Inventor: Hitoshi Matsushima, Ryugasaki (JP)

(73) Assignee: Hitachi Air Conditioning Systems Co., Ltd., Tokyo (JP)

( * ) Notice: Subject to any disclaimer, the term of this patent is extended or adjusted under 35 U.S.C. 154(b) by 70 days.

(21) Appl. No.: 10/601,526

(22) Filed: Jun. 24, 2003

(65) Prior Publication Data

US 2004/0011515 A1 Jan. 22, 2004

(30) Foreign Application Priority Data

Jun. 24, 2002 (JP) ..... 2002-182318

(51) Int. Cl.[7] ..... F28F 3/04; F28F 3/10
(52) U.S. Cl. ..... 165/167; 165/166
(58) Field of Search ..... 165/166, 167

(56) References Cited

U.S. PATENT DOCUMENTS 2,676,000 A * 4/1954 Ekwall ..... 165/167
3,450,200 A * 6/1969 Wright ..... 165/167
3,792,730 A * 2/1974 Andersson ..... 165/167
4,635,714 A * 1/1987 Almqvist et al. ..... 165/167
4,724,902 A * 2/1988 Gross ..... 165/166
6,478,080 B2 * 11/2002 Pinto ..... 165/167

FOREIGN PATENT DOCUMENTS

FR 2618889 A1 * 2/1989 ..... 165/166
JP A-56-034096 4/1981
JP A-4-139388 5/1992
WO WO00/16029 3/2000

* cited by examiner

*Primary Examiner*—Leonard R. Leo
(74) *Attorney, Agent, or Firm*—Antonelli, Terry, Stout & Kraus, LLP

(57) ABSTRACT

A plate type heat exchanger comprises a plurality of plates stacked on one another. Each of the plates has a seal portion, which is provided on an outer peripheral portion of the plate and with an interior of which inflow and outflow ports of heat exchanging fluids are communicated, and heat-transfer surface elements formed in a mountain-shaped manner in a thicknesswise direction of the plate and arranged to form flow passages within the seal portion. The heat-transfer surface elements are in the form of a quadrangular pyramid having flat top. The seal portion has flat portions on outer peripheral portions of the flow passages to define a bottom surface, and mountain portions, which extend upright from the flat portions and of which tops are formed to be flat in shape.

13 Claims, 3 Drawing Sheets

PLATE TYPE HEAT EXCHANGER

BACKGROUND OF THE INVENTION

The present invention relates to a plate type heat exchanger, and more particularly, to a heat exchanger for refrigerating and air conditioning, suitable for a vapor compression type refrigeration cycle.

Conventionally, in order to make a plate type heat exchanger compact and improve its heat transfer performance, it has been known to form heat-transfer surface elements having mountains and valleys in a thicknesswise direction of a plate and to provide micro fins on surfaces of the elements, which arrangement is described in International Publication WO00/16029.

The above-described conventional art is designed with use for the vapor compression type refrigeration cycle in mind, and therefore, it has been difficult to adequately ensure pressure tightness in use of high-pressure refrigerants typified by R410A and carbon dioxide. Also, when it is used as an evaporator such as a chiller unit, there is a fear that cold water freezes and seals break to cause mixing of water and a refrigerant when a working temperature on a refrigeration cycle side greatly decreases.

BRIEF SUMMARY OF THE INVENTION

It is an object of the invention to make a heat exchanger compact and good in heat transfer performance and to increase its pressure tightness to enable use of a high-pressure refrigerant. Also, it is an object of the invention to suit a heat exchanger to an evaporator, such as low-temperature chiller unit or the like, without the possibility of breakage of seals even in the case where cold water freezes in the heat exchanger.

To attain the above-described objects, the invention provides a plate type heat exchanger comprising a plurality of plates stacked on one another, each of the plates having a seal portion, which is provided on an outer peripheral portion of the plate and with an interior of which inflow and outflow ports of heat exchanging fluids are communicated, and heat-transfer surface elements formed in a mountain-shaped manner in a thicknesswise direction of the plate and arranged to form flow passages within the seal portion, characterized in that the heat-transfer surface elements are in the form of a quadrangular pyramid having flat top, and the seal portion having flat portions on outer peripheral portions of the flow passages to define a bottom surface, and mountain portions, which extend upright from the flat portions and of which tops are formed to be flat in shape.

Also, it is desired in the plate type heat exchanger that the flat portions and mountain portions of the vertically adjacent plates are stacked on one another to overlap each other.

Further, it is desired that a part of the heat-transfer surface elements comprise a flat portion defining a bottom surface of the plate and a mountain portion, which extends upright from the flat portion and of which a top is formed to be flat in shape, and the vertically adjacent flat portions and mountain portions are stacked on one another to overlap each other.

Further, it is desired that a part of the heat-transfer surface elements arranged centrally in a widthwise direction of the plate comprise a flat portion defining a bottom surface of the plate and a mountain portion, which extends upright from the flat portion and of which a top is formed to be flat in shape, and the vertically adjacent flat portions and mountain portions are stacked on one another to overlap each other.

Further, it is desired that the flat portions and the mountain portions on the seal portion are arranged alternately in a flow direction of the flow passages and the flat portions and mountain portions of the plates are stacked on one another to overlap each other.

Further, it is desired that R410A flow through one of the flow passages defined by the stacked plates and water flow through the other of the flow passages.

Further, it is desired that carbon dioxide flow through one of the flow passages defined by the stacked plates and water flow through the other of the flow passages.

Further, it is desired that a zeotropic refrigerant mixture flow through at least one of the flow passages defined by the stacked plates counter to a flow through the other of the flow passages.

Other objects, features and advantages of the invention will become apparent from the following description of the embodiments of the invention taken in conjunction with the accompanying drawings.

DETAILED DESCRIPTION OF THE INVENTION

Figure 1:
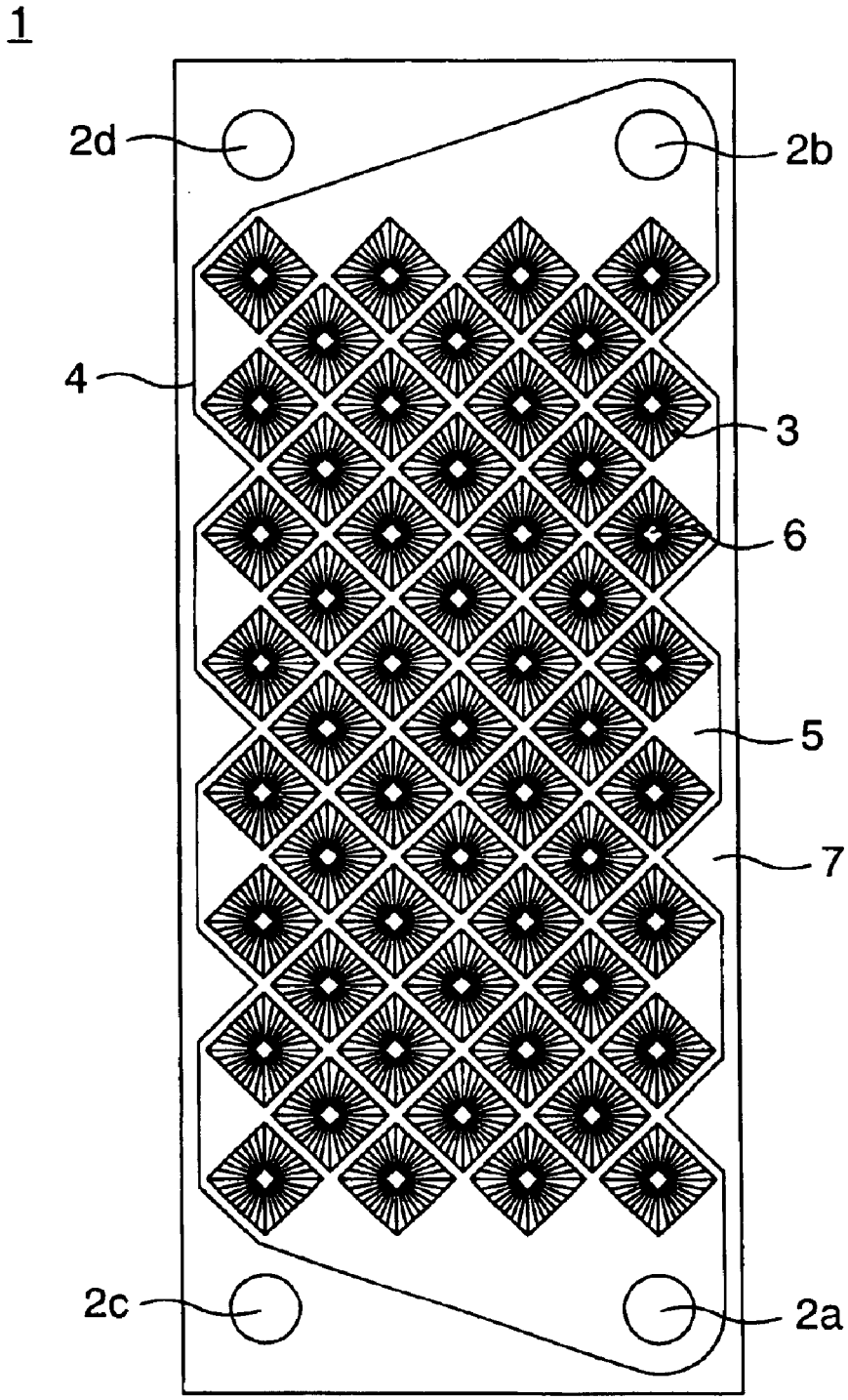
FIG. 1 is a plan view showing a plate according to an embodiment of the invention.

Embodiments of the invention will be described with reference to FIGS. 1 to 3. FIG. 1 is a plan view showing a plate 1 constituting a plate type heat exchanger, and FIG. 2 is a plan view (as viewed from a back side of FIG. 1) showing a state, in which the plates 1 are alternately turned upside down to be stacked on one another.

The plate 1 is formed by press working of a thin metallic sheet and has four openings 2*a* to 2*d*. Only two openings 2*a*, 2*b* define a flow passage in the plate 1, and the flow passage is partitioned by a seal portion 4. Pyramid-shaped heat-transfer surface elements 3 are formed on the plate 1, which define mountains or valleys in a thicknesswise direction of the plate, and of which upper end portions 6 have flat tops, that is, the surface elements 3 being in the form of a truncated quadrangular pyramid. And the pyramid-shaped heat-transfer surface elements 3 are arranged in a zigzag manner and substantially equally spaced from each other. Therefore, flow passages are formed between the heat-transfer surface elements 3 to be configured in a mesh and substantially constant in width. Also, with the arrangement shown in FIG. 1, micro fins, which are smaller in height than the heat-transfer surface elements 3, are provided on surfaces, which define inclined surfaces of the mountains and valleys, to improve the heat transfer performance still more.

Figure 2:
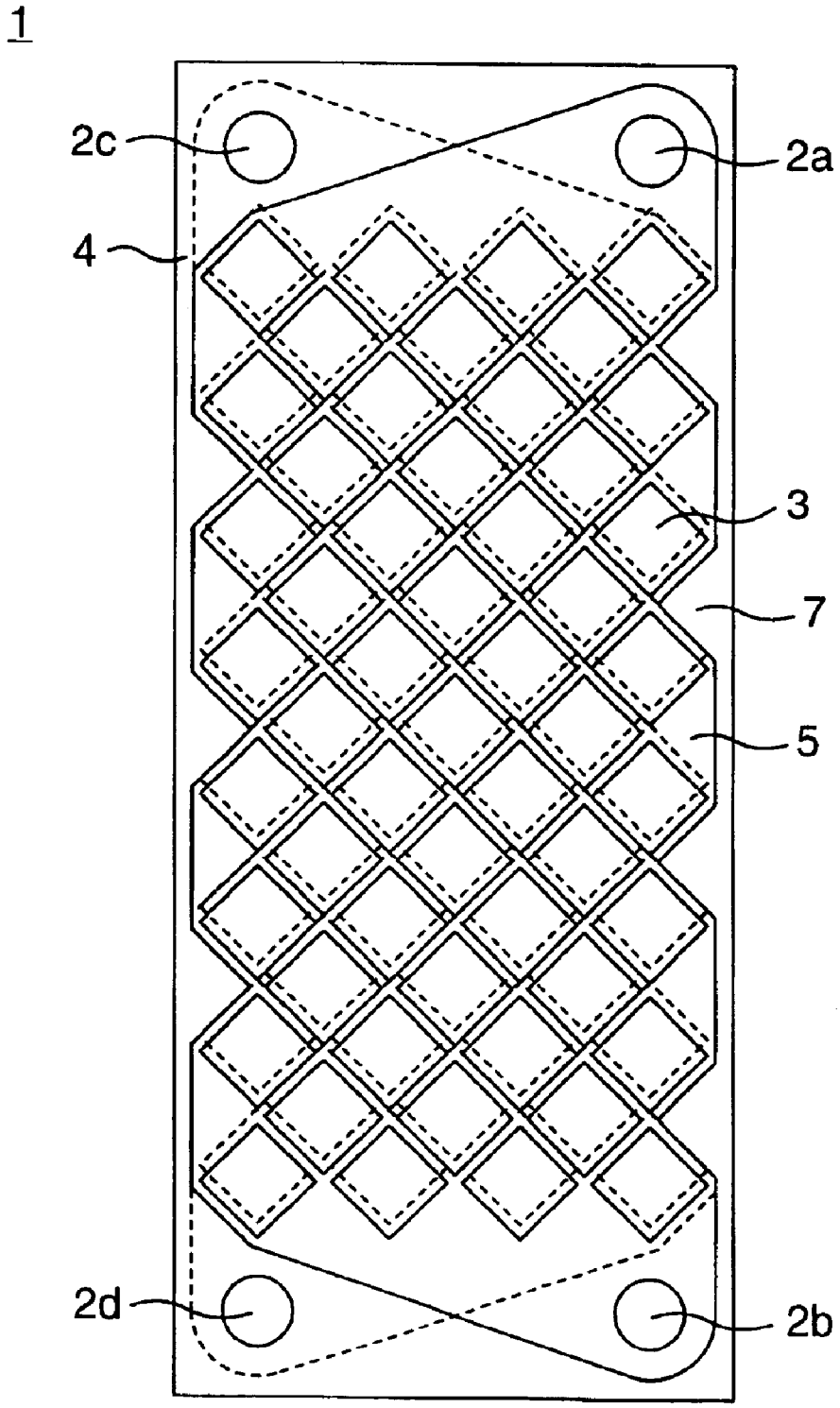
FIG. 2 is a plan view showing a state, in which plates according to the embodiment of the invention are stacked on one another.

The plates 1 are alternately turned upside down and stacked on one another as shown in FIG. 2. The upper end portions 6 of the plate 1 laid below are in contact with intersections of the flow passages (bottoms of the heat-transfer surface elements 3) of the plate 1 laid above. Thus, with a multiplicity of such contact points formed on the plates 1, it is possible to obtain a high pressure strength. Thereby, a practically sufficient pressure tightness is obtained for a comparatively low pressure refrigerant, such as R22, R404A, or the like, usually used for a chiller unit. Further, since the pyramid-shaped heat-transfer surface elements 3 are arranged three-dimensionally in the flow passages, mixing of fluids is promoted. Also, the micro fins serve to promote mixing of fluids still more but without the provision of the micro fins, an adequate performance can be obtained provided that the pyramid-shaped heat-transfer surface elements 3 form a three-dimensional flow.

In the case where the plates are used as a water-refrigerant heat exchanger for a chiller unit, taking account of a heat exchanging performance and the influence of gravitation, in case of an evaporator, the refrigerant is made to flow into the opening 2*a* disposed below, to flow between the heat-transfer surface elements 3 on the plate 1, and then to flow out of the opening 2*b* disposed above, and water is made to flow into the opening 2*d* disposed above, to flow between the heat-transfer surface elements 3 on the adjacent plate 1, and then to flow out of the opening 2*c* disposed below. Conversely, in case of a condenser, the refrigerant is made to flow into the opening 2*b* disposed above, to flow between the heat-transfer surface elements 3 on the plate 1, and then to flow out of the opening 2*a* disposed below, and water is made to flow into the opening 2*c* disposed below, to flow between the heat-transfer surface elements 3 on the adjacent plate 1, and then to flow out of the opening 2*d* disposed above. Thereby, flows become completely countercurrent flows, which is specifically effective to enhance the efficiency of refrigeration cycle in the case where a zeotropic refrigerant mixture such as R407C or the like is used as a refrigerant.

It is feared, according to operating conditions, that the flow passages on the water side freeze, and when freezing occurred, the surrounding seal portion 4 could break due to volume expansion to cause leakage of the refrigerant and mixing of the refrigerant into water. Hereupon, the seal portion 4 is increased in bond strength to enhance the pressure tightness so that breakage will not be caused even when freezing of the plates occurs, or application to carbon dioxide used for water heaters, and high-pressure refrigerants, such as R401A, or the like, used for room air-conditioners is made possible.

The seal portion 4 in the embodiment shown in FIG. 1 is configured such that flat portions 5 and mountain portions 7 are formed alternately in a flow direction and patterns of formation of the flat portions 5 and the mountain portions 7 on both right and left sides are shifted ½ pitch relative to each other. The mountain portions 7 have a bottom surface in the form of a triangle, which is obtained by dividing a square substantially into halves. Thereby, in a state, in which the plates 1 are alternately turned upside down to be stacked on one another, the mountain portions 7 on the plate 1 disposed below come into contact in a large area with the flat portions 5 on the plate 1 disposed above as shown in FIG. 2, so that such contact portions formed on peripheral portions of the plates 1 can sharply enhance the pressure tightness and the sealing property.

Figure 3:
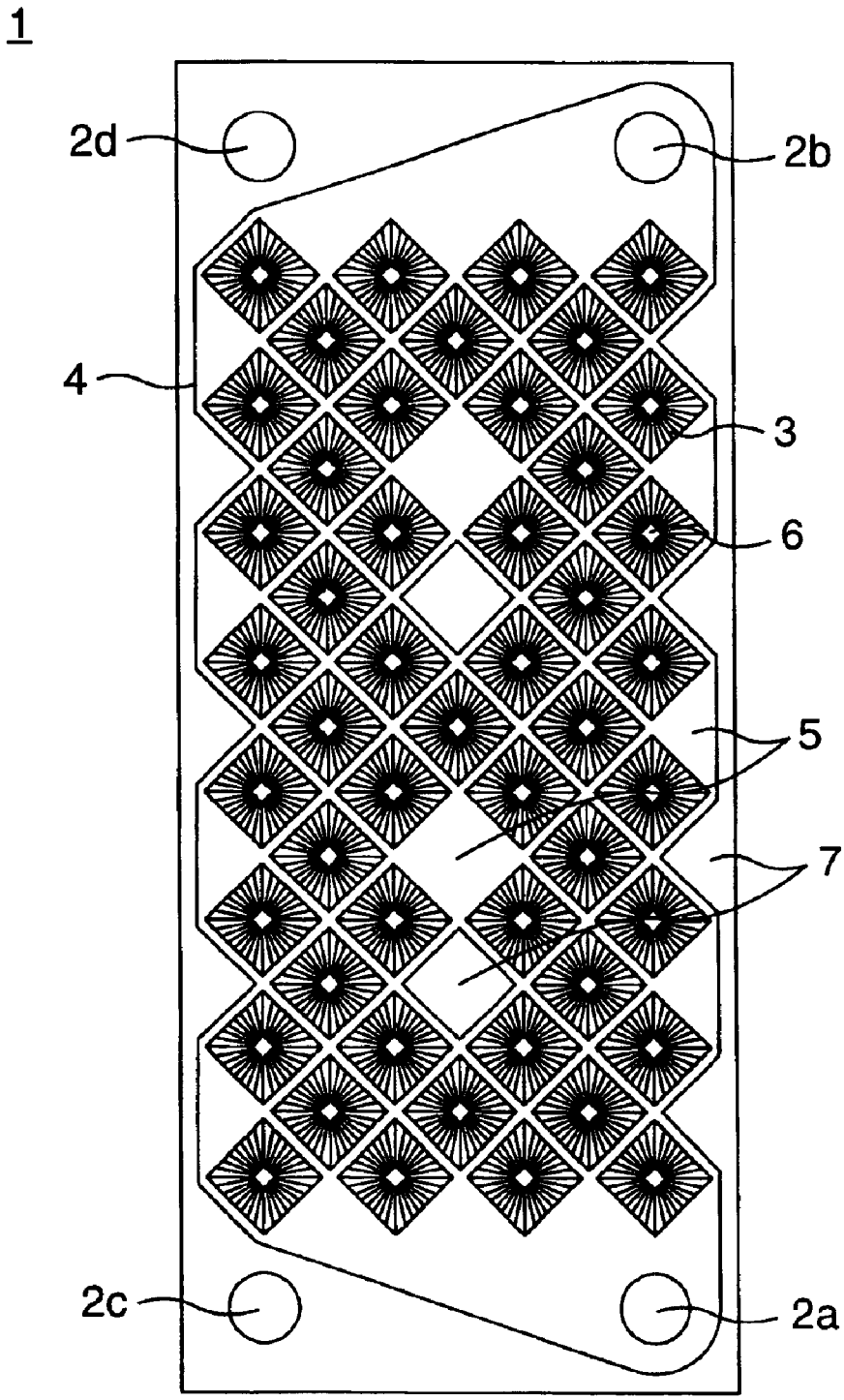
FIG. 3 is a plan view showing a plate according to another embodiment of the invention.

FIG. 3 shows another embodiment, in which flat portions 5 and mountain portions 7 are formed centrally of plates in contrast to the embodiment shown in FIG. 1. In a state, in which plates 1 are alternately turned upside down to be stacked on one another, the mountain portions 7 on the plate 1 disposed below come into contact in a large area with the flat portions 5 on the plate 1 disposed above, so that such contact portions formed on central and peripheral portions of the plates 1 can sharply enhance the pressure tightness and the sealing property.

In addition, since substantially the same heat transfer performance is obtained whichever of the openings 2*a*, 2*b* fluids flow into, even when, for example, a refrigerant is R401A which is used for room air-conditioners, the plates can be used for condensers (operating pressure of 3 to 4 MPa). Further, even when a refrigerant is carbon dioxide which is used for water heaters, the plates can be adequately used for evaporators (operating pressure of 3 to 4 MPa) and also for condensers (operating pressure of 10 to 17 MPa).

According to the invention, it is possible to obtain a plate type heat exchanger, which is compact and good in heat transfer performance and enhanced in pressure tightness.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A plate type heat exchanger comprising a plurality of plates alternately turned and stacked on one another, the plates commonly facing the direction of stacking, each of said plates having: a seal portion, which is provided on an outer peripheral portion of the plate and with an interior of which inflow and outflow ports of heat exchanging fluids are communicated; and heat-transfer surface elements formed in a mountain-shaped manner in a thicknesswise direction of the plate and arranged to form flow passages within the seal portion, wherein the heat-transfer surface elements are in the form of a quadrangular pyramid having flat top, and the seal portion having flat portions on outer peripheral portions of the flow passages to define a bottom surface, and mountain portions, which extend upright from the flat portions and of which tops are formed to be flat in shape, and wherein the flat portions and the mountain portions on the seal portion are arranged alternately in a flow direction of the flow passages.

2. A plate type heat exchanger according to claim 1, wherein the flat portions and mountain portions of the vertically adjacent plates are stacked on one another to overlap each other.

3. A plate type heat exchanger according to claim 1, wherein a part of the heat-transfer surface elements comprises a flat portion defining bottom surface of the plate and a mountain portion, which extends upright from the flat portion and of which a top is formed to be flat in shape, and wherein the flat portions of the heat-transfer surface elements are stacked on and overlap the vertically adjacent mountain portions of the heat-transfer surface elements.

4. A plate type heat exchanger according to claim 1, wherein a part of the heat-transfer surface elements arranged centrally in a widthwise direction of the plate comprises a flat portion defining bottom surface of the plate and a mountain portion, which extends upright from the flat portion and of which a top is formed to be flat in shape, and wherein the flat portions of the part of the heat-transfer surface elements are stacked on and overlap the vertically adjacent mountain portions of the part of the heat-transfer surface elements.

5. A plate type heat exchanger according to claim 1, wherein the flat portions are stacked on and overlap the vertically adjacent mountain portions.

6. A plate type heat exchanger according to claim 1, further comprising R410A flowing through one of the flow passages defined by the stacked plates and water flowing through the other of the flow passages.

7. A plate type heat exchanger according to claim 1, further comprising carbon dioxide flowing through one of the flow passages defined by the stacked plates and water flowing through the other of the flow passages.

8. A plate type heat exchanger according to claim 1, further comprising a zeotropic refrigerant mixture flowing through at least one of the flow passages defined by the stacked plates counter to a flow through the other of the flow passages.

9. A plate type heat exchanger according to claim 1, wherein bottoms of the mountain portions have a triangular shape.

10. A plate type heat exchanger according to claim 1, wherein tops of mountain portions in the seal portion of one plate contact flat portions in the seal portion of another plate disposed above the one plate.

11. A plate type heat exchanger according to claim 1, wherein all of the plurality of plates are identical and are alternately turned so that tops of mountain portions in the seal portion of one plate contact flat portions in the seal portion of another plate disposed above the one plate.

12. A plate type heat exchanger according to claim 1, wherein a part of the heat-transfer surface elements comprises a flat portion defining bottom surface of the plate and a mountain portion, which extends upright from the flat portion and of which a top is formed to be flat in shape, and wherein the flat portions of the heat-transfer surface elements are stacked on and overlap the vertically adjacent mountain portions of the heat-transfer surface elements.

13. A plate type heat exchanger according to claim 1, wherein a part of the heat-transfer surface elements arranged centrally in a widthwise direction of the plate comprises a flat portion defining bottom surface of the plate and a mountain portion, which extends upright from the flat portion and of which a top is formed to be flat in shape, and wherein the flat portions of the part of the heat-transfer surface elements are stacked on and overlap the vertically adjacent mountain portions of the part of the heat-transfer surface elements.

* * * * *